US012064800B2

(12) United States Patent
Amborn

(10) Patent No.: US 12,064,800 B2
(45) Date of Patent: Aug. 20, 2024

(54) METHOD FOR FORMING A SHEET BLANK AS A WORKPIECE IN A FORMING TOOL

(71) Applicant: HoDforming GmbH, Düsseldorf (DE)

(72) Inventor: Peter Amborn, Neunkirchen-Seelscheid (DE)

(73) Assignee: HODFORMING GMBH, Düsseldorf (DE)

( * ) Notice: Subject to any disclaimer, the term of this patent is extended or adjusted under 35 U.S.C. 154(b) by 999 days.

(21) Appl. No.: 16/195,396

(22) Filed: Nov. 19, 2018

(65) Prior Publication Data

US 2019/0151922 A1 May 23, 2019

(30) Foreign Application Priority Data

Nov. 17, 2017 (DE) ..... 10 2017 127 158.9

(51) Int. Cl.

| | |
|---|---|
| ***B21D 22/02*** | (2006.01) |
| ***B21D 22/20*** | (2006.01) |
| ***B21D 22/30*** | (2006.01) |
| ***B21D 26/021*** | (2011.01) |
| ***B21D 26/027*** | (2011.01) |

(Continued)

(52) U.S. Cl.

CPC ..... *B21D 22/022* (2013.01); *B21D 22/208* (2013.01); *B21D 22/30* (2013.01); *B21D 26/021* (2013.01); *B21D 26/027* (2013.01); *B21D 26/033* (2013.01); *B21D 26/043* (2013.01); *C21D 8/0247* (2013.01); *C21D 9/48* (2013.01)

(58) Field of Classification Search

CPC ... C21D 8/0247; B21D 22/022; C12D 8/0247

See application file for complete search history.

(56) References Cited

U.S. PATENT DOCUMENTS

2010/0212389 A1* 8/2010 Kipry ..... B21D 26/049 72/347
2011/0094282 A1* 4/2011 Overrath ..... C21D 1/18 72/342.1

(Continued)

FOREIGN PATENT DOCUMENTS

DE 00420071 T1 4/2004
DE 69923742 T2 1/2006

(Continued)

OTHER PUBLICATIONS

Espacenet machine translation of DE-102016100589-A1 retrieved on Jan. 25, 2022 (Year: 2017).*

(Continued)

*Primary Examiner* — Jophy S. Koshy
*Assistant Examiner* — Joshua S Carpenter
(74) *Attorney, Agent, or Firm* — BakerHostetler

(57) ABSTRACT

A method is provided for forming a flat metal blank as a workpiece in a forming die. The method may include providing a forming die with at least one cavity, and providing at least one blankholder for fixing a flat metal blank to the at least one cavity during the forming. The method may also include heating the flat metal blank to a solution heat treatment temperature specific to the flat metal blank while maintaining the forming die at the solution heat treatment temperature. The method may also include forming the workpiece from the flat metal blank at the solution heat treatment temperature.

13 Claims, 6 Drawing Sheets

(51) Int. Cl.

| | |
|---|---|
| ***B21D 26/033*** | (2011.01) |
| ***B21D 26/043*** | (2011.01) |
| ***C21D 8/02*** | (2006.01) |
| ***C21D 9/48*** | (2006.01) |

(56) References Cited

U.S. PATENT DOCUMENTS

| | | | | |
|---|---|---|---|---|
| 2011/0209512 | A1 | 9/2011 | Lee | |
| 2012/0040205 | A1* | 2/2012 | Lenze | C21D 1/673 428/600 |
| 2019/0100084 | A1* | 4/2019 | Otsuka | B60J 5/0451 |
| 2019/0299267 | A1* | 10/2019 | Boulin | B21D 37/08 |

FOREIGN PATENT DOCUMENTS

| | | | | |
|---|---|---|---|---|
| DE | 112005000491 | T5 | 1/2007 | |
| DE | 602005003300 | T2 | 9/2008 | |
| DE | 102012007213 | A1 | 11/2012 | |
| DE | 102014003350 | A1 | 9/2015 | |
| DE | 102016100589 | A1 * | 7/2017 | B21D 22/022 |
| DE | 102016100589 | A1 | 7/2017 | |
| EP | 2324938 | A1 | 5/2011 | |
| GB | 1490535 | A * | 11/1977 | C21D 1/02 |
| JP | 6206629 | B1 * | 10/2017 | B21D 22/208 |
| WO | 2015136299 | A2 | 9/2015 | |

OTHER PUBLICATIONS

Kaufman, "Properties and Characteristics of Aluminum and Aluminum Alloys", Fire Resistance of Aluminum and Aluminum Alloys and Measuring the Effects of Fire Exposure on the Properties of Aluminum Alloys, 2016.

Milkereit, et al., "Dissolution and Precipitation Behavior for Hot Forming of 7021 and 7075 Aluminum Alloys", Metals, vol. 8, 531, 2018.

Alvarez-Antolin, et al., "Analysis of Different Solution Treatments in the Transformation of β-AlFeSi Particles into α-(FeMn)Si and Their Influence on Different Ageing Treatments in Al—Mg—Si Alloys", Metals, 10, 620, 2020.

* cited by examiner

METHOD FOR FORMING A SHEET BLANK AS A WORKPIECE IN A FORMING TOOL

CROSS-REFERENCE TO RELATED APPLICATIONS

This application claims priority from German Application No. DE 10 2017 127 158.9 filed Nov. 17, 2017, the entire content of which is incorporated herein by reference.

FIELD OF THE INVENTION

The present invention on the one hand relates to a method of forming a flat metal blank, e.g. a sheet metal blank, as a workpiece in a forming die, e.g. in a forming press, wherein the forming die has at least one cavity and advantageously at least one blankholder for fixing the workpiece to the cavity during the forming. On the other hand, the subject of the invention is a method of forming a hollow body blank as a workpiece in a forming die, e.g. in a forming press, having in particular at least one locking apparatus for the hollow body blank, wherein the forming die has at least one cavity with at least one opening for receiving the hollow body blank during forming.

BACKGROUND OF THE INVENTION

Forming processes are sufficiently known from the prior art. It is thus known from WO 2015/136299 A2, for example, to initially heat a metal workpiece to the range of the solution heat treatment temperature, to then cool the workpiece down to the forming temperature in a further step, and to form the workpiece, with the workpiece continuing to cool in an uncontrolled manner during the forming and with the forming material solidifying in an uncontrolled manner, which produces a springback effect. The workpiece is removed from the mold at the end of the forming. The comparatively long cycle time, the non-optimal forming temperature that is too cold, and the springback that impairs the keeping of tolerances are disadvantageous in these known methods. The long cycle time is due to the unfavorable sequence of machining processes up to the actual forming such as namely in particular the heating to the solution heat treatment temperature and the subsequent cooling prior to the forming, including the time of cooling of the workpiece in the tool and the cooling during the forming process. Too fast a cooling of the flat metal blank during the forming in particular only permits small degrees of forming with small elongations A80 of the workpiece in particular with high-strength alloys and/or small wall thicknesses. Tight radii and sharp edges can accordingly not be reproduced since the thinner the wall thickness of the flat metal blank, the faster it also cools after insertion into the tool, and indeed before it has been completely formed.

The so-called superplastic forming (SPF) is furthermore likewise part of the prior art. In superplastic forming, the workpiece, that is a flat metal blank or a hollow body blank, for example, is fixedly clamped in the forming die that is heated to the superplastic temperature and this is as a rule in a furnace. This means that the flat metal blank, for example, is sealed in a shape-matched manner between the two forming die halves on a closing so that no material can flow into the cavity during the forming. The consequence thereof is that the wall thickness of the workpiece in the cavity is undefined with respect to the location in the cavity. This means that the wall thickness can have different thicknesses, that are not definable in advance, at different points in dependence on the coefficients of friction or temperatures present there. To this extent, the formation of the wall thickness takes place more or less randomly in the cavity.

The demand on the forming material that it behaves superplastically has likewise proved to be disadvantageous in SPF. This considerably increases the price of the blank material. The SPF cycle times likewise amount to minutes up to days in dependence on the degree of forming. The SPF technology is also generally not used for larger volumes to this extent since it is not economic.

SUMMARY OF THE INVENTION

The underlying object of the invention comprises providing a remedy here. A method should in particular be provided with which short cycle times can be realized in forming with a substantially predefinable wall thickness of the workpiece.

The method should furthermore be suitable for forming high-strength alloys of any desired wall thickness and with desired high degrees of forming. It is furthermore the aim of the method to manufacture workpieces having a predefinable wall thickness and also those workpieces that are characterized by small radii, wherein the cycle times during the forming should be kept as small as possible.

In accordance with a first embodiment of a method of forming a flat metal blank as a workpiece in a forming die in which the forming die has at least one engraving or cavity and advantageously at least one blankholder for fixing the workpiece to the cavity during the forming, provision is made in accordance with the invention to achieve the object that the forming takes place in the solution heat treatment temperature range of the material of the flat metal blank to be formed, with the pressure for fixing the flat metal blank to the cavity being selected such that material of the flat metal blank can flow into the cavity and/or with material of the flat metal blank being actively pushed into the cavity or with the forming taking place fully without any additional workpiece material in the cavity. The blankholder can be advantageous with specific forming processes, for example in deep drawing using a punch, wherein the material advance into the cavity is controllable by the blankholder.

If a blankholder is provided, the compression force or the pressing force on the workpiece between the blankholder and the cavity is decisive for the question whether and, optionally, how much material of the workpiece can flow into the cavity.

In accordance with a second embodiment, provision is made in accordance with the invention for the forming of a hollow body blank as a workpiece in a forming die, in particular having at least one locking apparatus for the hollow body blank, wherein the forming die has at least one engraving or cavity for receiving the hollow body blank during the forming, that the forming takes place in the solution heat treatment temperature range of the material of the workpiece to be formed, wherein the workpiece (the hollow body blank) is held by the locking apparatus such that material of the workpiece can flow and/or the material of the workpiece is actively pushed into the cavity or such that the forming takes place on the basis of the material of the hollow body blank that is located within the cavity.

The methods of the invention therefore comprise heating the workpiece to be formed, that is, for example, the flat metal blank, to the solution heat treatment temperature or to the austenitization temperature in order then to carry out the forming on completion of or during the solution heat treatment process or on completion of the austenitization in the cavity likewise advantageously brought to this temperature. This means that a springback less forming is possible by the forming at the solution heat treatment temperature. It would also be conceivable in this connection, if the workpiece had already run through a solution heat treatment process or had been austenitized, to carry out the forming in the die permanently heated to proximity to the solution heat treatment temperature in the range of the ideal elongation of the material of the workpiece. The term "permanently" should at least describe the time period during the solution heat treatment and the forming. The temperature should advantageously be maintained during the daily production process because then the wear can be reduced, in particular at the cavity. This is with respect to a constant heating and cooling of the forming die, which results in increased wear at the forming die since the cooling is to be considered equivalent to a recurring thermal shock.

The solution heat treatment temperature should also be understood as the austenitization temperature with respect to steel in the following. This means that the term of solution heat treatment temperature to this degree represents an umbrella term for a specific thermal treatment at a temperature that also comprises the austenitization temperature of steel.

As already stated, the subject of the method is the heating of the workpiece to the solution heat treatment temperature range that is specifically provided for the material of the workpiece to be formed. The temperature is here advantageously selected such that it enables a solution heat treatment, but does not damage the material structure or, with martensitic steels, for example, the temperature for the austenitization or solution heat treatment is above the AC3 line, that is approximately at 950° C.

Depending on the material to be formed, the solution heat treatment process of the workpiece can be concluded before the start of forming, it can start during the solution heat treatment process, and it can also be concluded during the forming process. Which variant is selected depends, as already stated, on the material and on the aim of the implementation of a cycle time that is as small as possible.

Provision is made in accordance with a further feature of the invention that the workpiece is heated to the solution heat treatment temperature range or to the austenitization temperature range for the material of the workpiece before the introduction into the substantially permanently heated die. This also serves the reduction of the cycle time. The same applies to the temperature of the substantially permanently heated forming die.

It has been found to be particularly advantageous if the workpiece is removed from the forming die and is supplied to a hardening process after the conclusion of the forming and/or after the conclusion of the solution heat treatment process. It is typically the case that the workpiece is brought to the solution heat treatment temperature before the hardening; austenitization is spoken of with respect to steel. If to this extent the forming already advantageously takes place at the solution heat treatment temperature, the workpiece can then be hardened directly optimally without a repeat heating of the workpiece after the forming, either by a corresponding cooling or forming at temperatures that are lower with respect to the solution heat treatment temperature.

It has proved to be further advantageous if, in dependence on the formation of a material reserve at the workpiece desired at a predefined location in the cavity, a corresponding temperature profile can be set in the cavity by a temperature control device. This means that, for example at points at which a smaller wall thickness is desired, the temperature in the cavity is higher than at other points of the cavity. A differentiation in the wall thickness can likewise be carried out in this connection in that a corresponding roughness profile is applied to the cavity in dependence on a material reserve at the workpiece desired at a predefined location in the cavity. This means that the flow behavior of the material can be influenced by a changed coefficient of friction at specific points in the cavity in order thus to create points of different material thickness.

A combination of the application of a specific roughness profile and of a temperature profile has proven to be particularly advantageous. It has been found that the wall thicknesses can in particular be set very finely at specific points in the cavity by such a combination.

In accordance with a further feature of the invention, the forming of the workpiece takes place in the cavity under gas pressure and/or mechanically using a punch. Provision is advantageously made in gas forming if a seal is arranged between the cavity or blankholder and the flat metal blank to prevent or to at least reduce the gas outlet. It has furthermore provided advantageous in this connection that the workpiece is captured by the cavity or by the blankholder after the conclusion of the forming process for calibration of the workpiece in the cavity such that substantially no workpiece material flows into the cavity. This measure serves a crease smoothing and in particular takes place above 60 bar in dependence on the radius size, on the material of the workpiece to be formed, and on the wall thickness of the workpiece. Provision can optionally likewise be made that a plurality of such forming dies can also be arranged one after the other to enable an optimal forming at optimal cycle times in a similar manner to cold forming. Optimal forming is understood as a forming of the workpiece in a plurality of steps that would not be reproducible in a single forming process. The total cycle time that was necessary overall for forming could be shortened with respect to e.g. superplastic forming here because the forming would be required in a plurality of steps and thus takes place overall in the range of the solution heat treatment temperature.

With the aid of the method in accordance with the invention, that is in particular with the aid of a method in which the forming takes place in the range of the solution heat treatment temperature and in which, as already initially explained, the material of the workpiece can flow from the region of the blankholder into the cavity, forming times of less than a minute can be realized, in particular of ≤20 seconds on forming under gas pressure and ≤10 seconds on mechanical forming (ideal 4 to 8 seconds). With an ideal combination of tools arranged behind one another, complex components of high-strength materials of any desired wall thicknesses having very small radii or sharp edges or very high degrees of forming of more than 200% can be formed in a very short cycle time.

BRIEF DESCRIPTION OF THE DRAWINGS

The invention will be described in more detail below by way of example with reference to the drawings. There are thus shown

DETAILED DESCRIPTION OF THE INVENTION

Figure 1A:
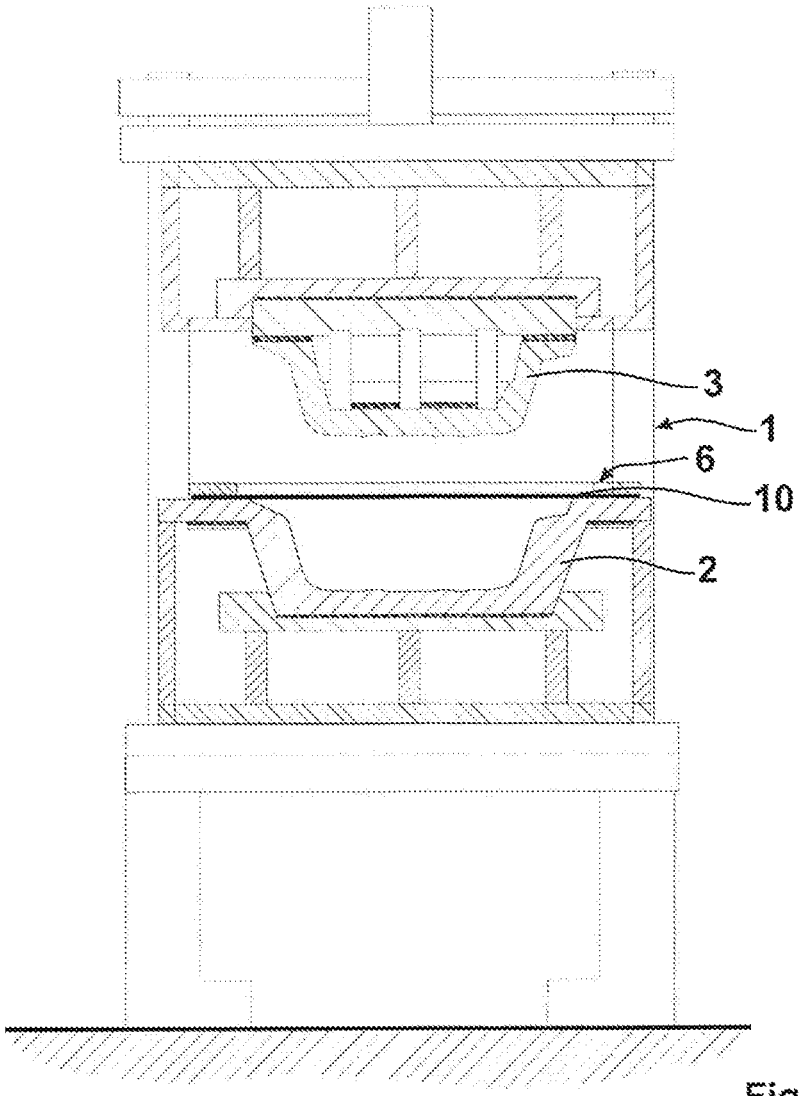
FIG. 1*a* and FIG. 1*b* show a forming press for forming a metallic flat blank using mechanical forming and additionally with gas pressure forming.

In detail, the cavity or die is shown by 2 and the punch by 3 in the forming press 1 of FIGS. 1*a*-1*e*. A gas supply is schematically indicated by 4. The flat metal blank has the reference numeral 10.

In this connection, a cavity or die and a punch for a purely mechanical forming of the flat metal blank 10 results from FIG. 1*a*. A blankholder for the flat metal blank has the reference numeral 6.

Figure 1B:
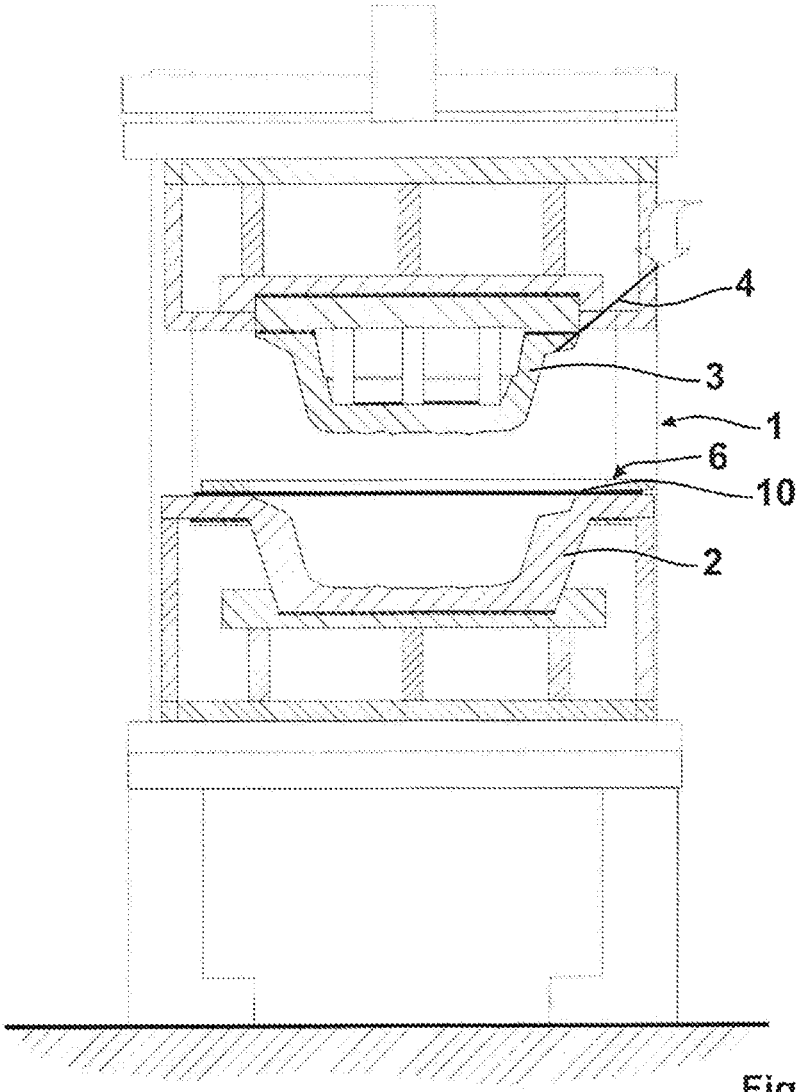

FIG. 1*b* shows a mechanical forming in combination with a gas pressure calibration, with here a gas supply 4 being provided in the region above the flat metal blank, that is in the region of the punch 3. A blankholder 6 is also provided here. The blankholder applies a pressing force onto the flat metal blank in conjunction with the cavity or die 2.

Figure 1C:
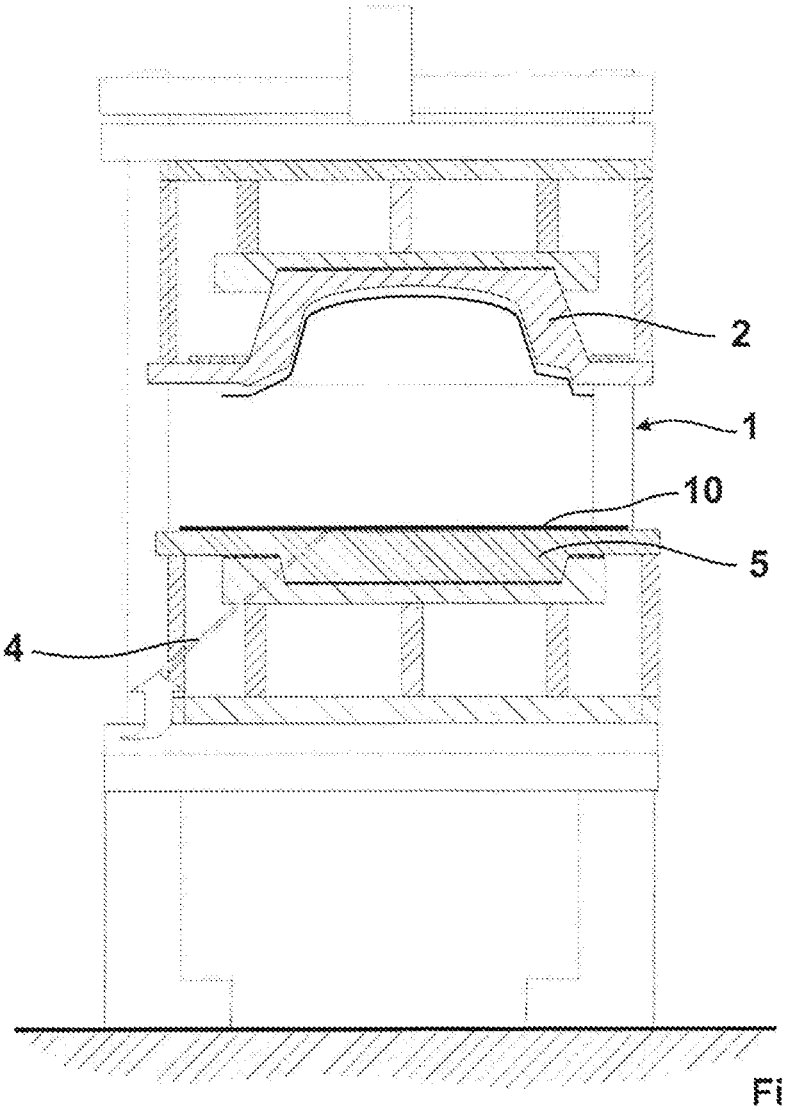
FIG. 1*c* to FIG. 1*e* show a forming process of a flat metal blank in three steps in different tools.

FIG. 1*c* shows a forming press in which the forming takes place by internal gas pressure in a first forming step. An internal pressure of, for example, 20 bar can be provided here, and indeed in dependence on the wall thickness and on the material, with material being able to be pushed into the cavity actively above the lower tool frame 5 in order to have sufficient material available, for example in a subsequent cold forming.

Figure 1D:
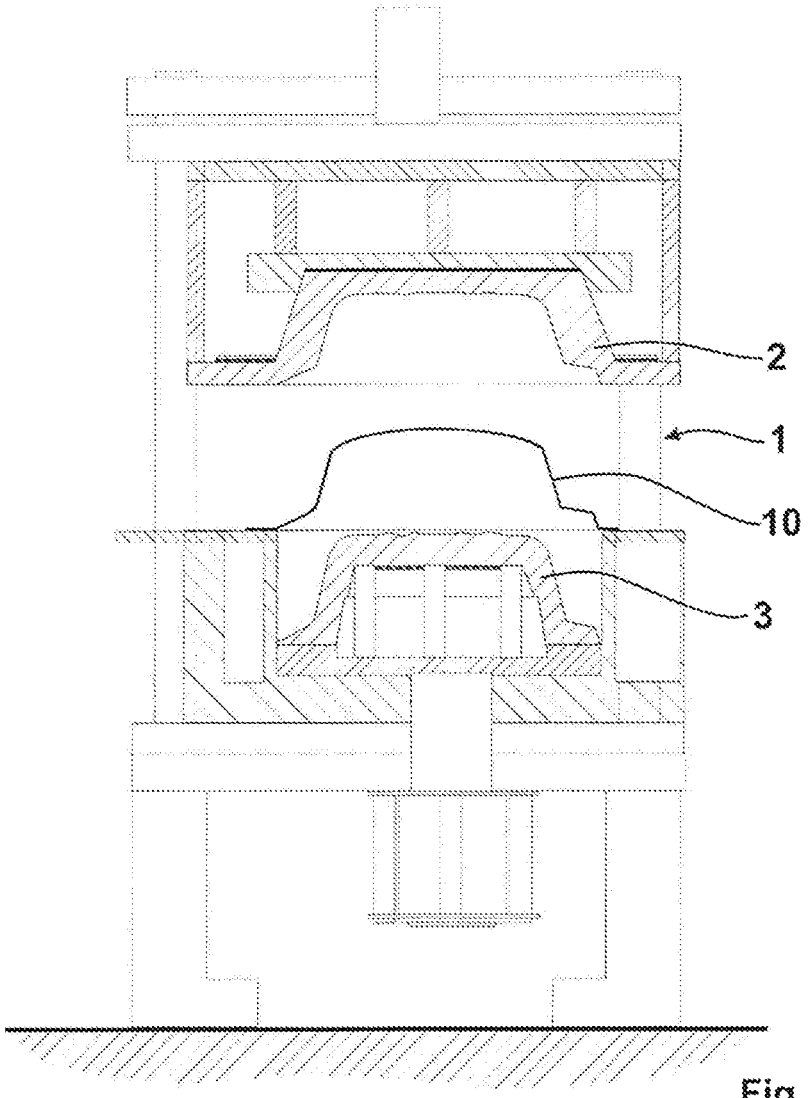

FIG. 1*d* shows a purely mechanical forming as a second forming step using a punch 3 and a cavity or die 2, with the material of the workpiece being able to be freely tracked. A free material feed is also spoken of here.

Figure 1E:
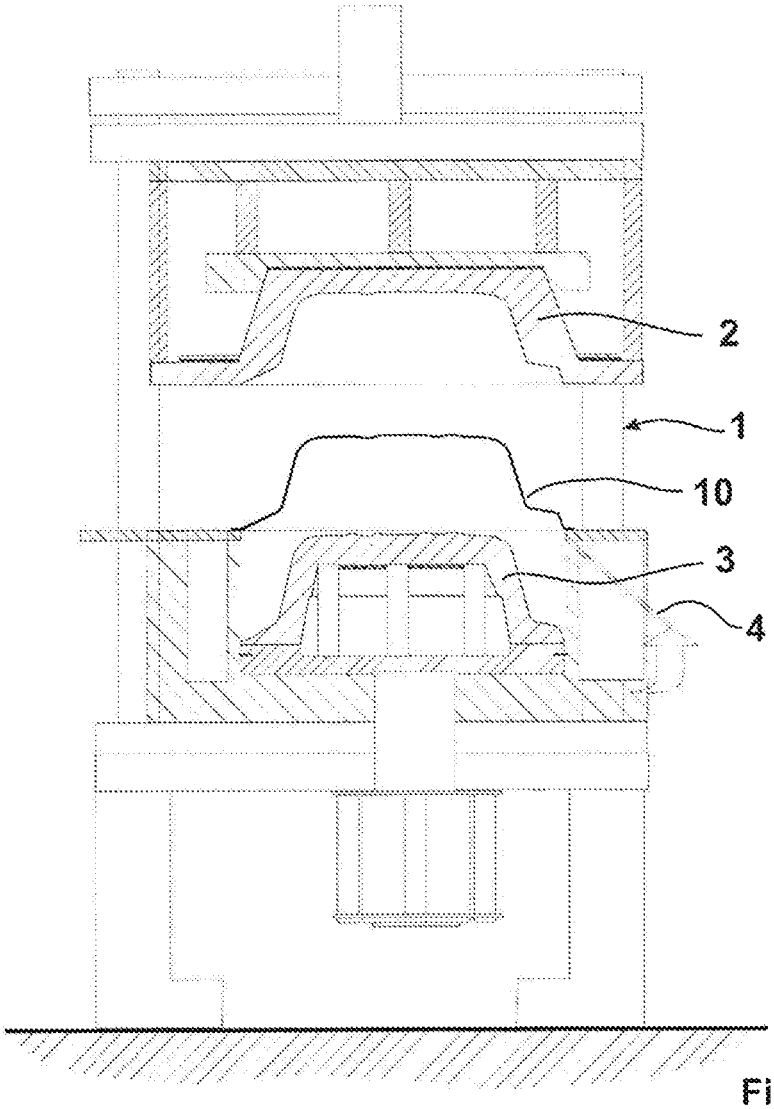

In FIG. 1*e*, a gas feed 4 into the space above the punch 3 is in turn provided for calibration in the third forming step, with the surface of the formed component being smoothed with a closed die at a high pressure of up to approximately 1000 bar, advantageously up to 200 bar, with sealed marginal regions. No material advance into the cavity takes place here.

Figure 2:
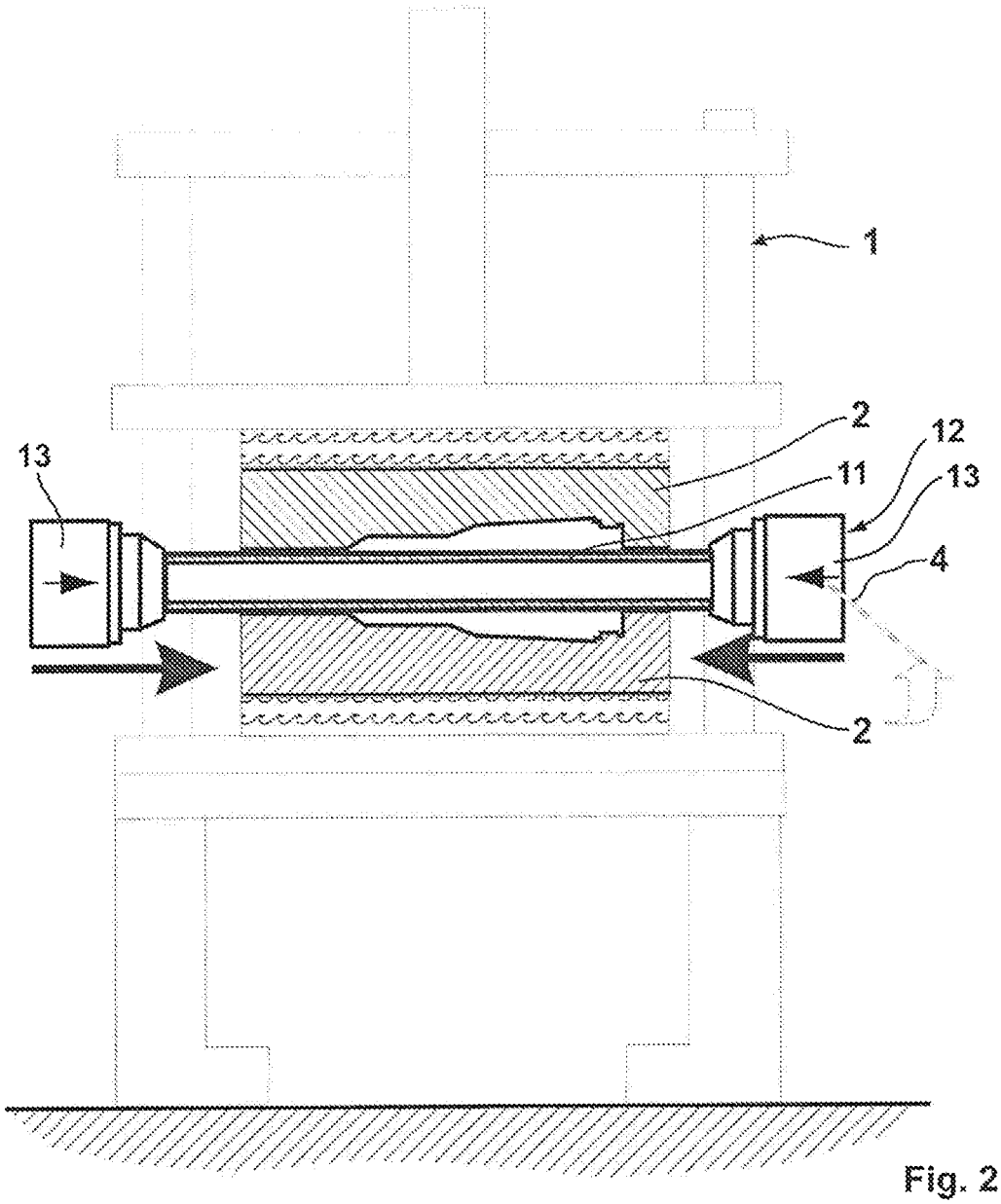
FIG. 2 shows a forming press for the forming of a hollow body blank.

FIG. 2 shows a forming press 1 having two die halves 2 for forming a hollow body blank 11. The hollow body blank is supported in the region between the die halves, with the cavities forming the negative mold for the final form formed from the hollow body blank. The blank sealing and blank feeding or locking apparatus 12 engages laterally at the hollow body blank. The locking apparatus 12 comprises a sealing cylinder 13 at each of the two sides of the hollow body blank that is also able push material of the hollow body blank into the space between the two cavities. At least one of the cylinders 13 can have an opening 4 for supplying a gas for forming the hollow body blank.

REFERENCE NUMERAL LIST

1 forming press
2 cavity or die
3 punch
4 gas supply
5 lower tool frame
6 blankholder
10 flat metal blank
11 hollow body blank
12 locking apparatus
13 cylinder of the locking apparatus

The invention claimed is:

1. A method of forming a workpiece from a flat metal blank in a forming die, comprising the steps of:
providing a forming die with at least one cavity;
providing at least one blankholder for fixing the flat metal blank to the at least one cavity during the forming;
heating the flat metal blank to a solution heat treatment temperature specific to the flat metal blank;
disposing the heated flat metal blank in the forming die while the forming die is set to the solution heat treatment temperature specific to the flat metal blank; and
forming the workpiece from the flat metal blank at the solution heat treatment temperature, while selecting a pressure of the at least one blankholder onto the flat metal blank to enable the material of the flat metal blank to be drawn from a region below the at least one blankholder into the at least one cavity, and/or
while actively pushing the flat metal blank above a lower tool frame into the at least one cavity.

2. The method in accordance with claim 1, wherein the heating of the flat metal blank is concluded before the start of the forming.

3. The method in accordance with claim 1, wherein the heating of the flat metal blank is completed before introduction into the forming die.

4. The method in accordance with claim 1, wherein the workpiece is removed from the forming die and is supplied to a hardening process after conclusion of the forming and/or after conclusion of the solution heat treatment process.

5. The method in accordance with claim 1, wherein the forming takes place under gas pressure and/or mechanically.

6. The method in accordance with claim 1, further comprising a step of providing a sealing element for gas forming to minimize the outlet of gas between the flat metal blank and the at least one cavity, or the flat metal blank and the at least one blankholder.

7. The method in accordance with claim 1, wherein subsequent to the forming, the workpiece is captured by the at least one blankholder to prevent entry of the flat metal blank material into the at least one cavity for a calibration of the workpiece in the at least one cavity, the calibration being provided by a high gas pressure up to 1000 bar.

8. The method in accordance with claim 1, wherein a cycle time between the charging of the forming die with the flat metal blank to be formed and the removal of the formed flat metal blank from the forming die amounts to ≤ a minute.

9. The method in accordance with claim 1, wherein the heat treatment temperature follows a heat treatment temperature profile.

10. The method in accordance with claim 1, wherein a cycle time between the charging of the forming die with the flat metal blank to be formed and the removal of the formed flat metal blank from the forming die amounts to ≤20 seconds on forming under gas pressure.

11. The method in accordance with claim 1, wherein a cycle time between the charging of the forming die with the flat metal blank to be formed and the removal of the formed flat metal blank from the forming die amounts to ≤10 seconds on a mechanical forming.

12. The method in accordance with claim 4, wherein the hardening process comprises a cooling process and/or a further forming process in a further forming die.

13. The method in accordance with claim 11, wherein the cycle time is between 4 and 8 seconds.

* * * * *